US009409300B2

(12) United States Patent
Wong et al.

(10) Patent No.: US 9,409,300 B2
(45) Date of Patent: Aug. 9, 2016

(54) OPEN CUTTER FOR A FOIL TYPE SHAVER AND METHOD FOR FABRICATING THE OPEN CUTTER

(71) Applicant: Raymond Industrial Limited, Hong Kong (HK)

(72) Inventors: Ying Man John Wong, Hong Kong (HK); Kwok Yung Anthony Law, Hong Kong (HK)

(73) Assignee: RAYMOND INDUSTRIAL LIMITED, Shatin (HK)

( * ) Notice: Subject to any disclaimer, the term of this patent is extended or adjusted under 35 U.S.C. 154(b) by 0 days.

(21) Appl. No.: 14/860,679

(22) Filed: Sep. 21, 2015

(65) Prior Publication Data

US 2016/0008993 A1 Jan. 14, 2016

Related U.S. Application Data

(62) Division of application No. 13/943,770, filed on Jul. 16, 2013, now Pat. No. 9,289,907.

(51) Int. Cl.

| | |
|---|---|
| ***B26B 19/04*** | (2006.01) |
| ***B26B 19/38*** | (2006.01) |
| *B26B 19/26* | (2006.01) |
| *B26B 19/12* | (2006.01) |

(52) U.S. Cl.

CPC ..... *B26B 19/044* (2013.01); *B26B 19/384* (2013.01); *B26B 19/04* (2013.01); *B26B 19/12* (2013.01); *B26B 19/26* (2013.01)

(58) Field of Classification Search

CPC .... B26B 19/044; B26B 19/384; B26B 19/04; B26B 19/12; B26B 19/26

See application file for complete search history.

(56) References Cited

U.S. PATENT DOCUMENTS 2,234,894 A * 3/1941 Bruecker ..... B26B 19/384 30/346.51
7,022,195 B2 * 4/2006 Otani ..... B26B 19/044 148/527

* cited by examiner

*Primary Examiner* — Sean Michalski
*Assistant Examiner* — Liang Dong
(74) *Attorney, Agent, or Firm* — Miller, Matthias & Hull LLP

(57) ABSTRACT

An open cutter for a foil type shaver includes a plurality of arch-shaped cutting strips formed by bending a metal plate formed with alternating parallel slots and cutting strips. A plurality of spaced apart protruding cutting edges having a first acute cutting angle is formed along two opposite sides of the cutting strips. A plurality of recessed cutting edges having a second acute cutting angle is formed between the plurality of protruding cutting edges. The protruding cutting edges of one cutting strip are facing the recessed cutting edges of an adjacent cutting strip, thereby generating continuous hair-lifting and hair-cutting actions as the open cutter is driven in oscillating directions by a motor. A method for fabricating the open cutter is also disclosed.

5 Claims, 2 Drawing Sheets

OPEN CUTTER FOR A FOIL TYPE SHAVER AND METHOD FOR FABRICATING THE OPEN CUTTER

CROSS REFERENCE TO RELATED APPLICATIONS

This application is a Divisional Application of U.S. patent application Ser. No. 13/943,770, filed on Jul. 16, 2013. This application is incorporated herein by reference.

FIELD OF TECHNOLOGY

The present application relates to an open cutter for a foil type shaver and a method for fabricating the open cutter.

BACKGROUND

An open cutter is one of the most popular types of cutter used in a foil type shaver. It is basically a bent metal sheet that is slotted in between to form cutting edges. The bent slotted metal sheet is then housed on a plastic or metal bridge that can be driven by a motor and oscillate side by side through an eccentric pin. On top of the open cutter is a flexible thin metal sheet with through-hole pattern on it. This flexible thin metal sheet is also known as a foil. The cutting of hair takes place when the open cutter is sliding on the inner surface of the foil. The hair passing through the through-holes of the foil can be cut by the open cutter oscillating at high speed. The cutting action is an interaction between the foil and the open cutter.

The above description of the background is provided to aid in understanding an open cutter for a foil type shaver, but is not admitted to describe or constitute pertinent prior art to the open cutter for a foil type shaver disclosed in the present application, or consider any cited documents as material to the patentability of the claims of the present application.

SUMMARY

According to one aspect, there is provided an open cutter for a foil type shaver. The open cutter may include a plurality of arch-shaped cutting strips formed by bending a metal plate formed with alternating parallel slots and cutting strips. Each arch-shaped cutting strip may have two opposite sides and a top surface in sliding contact with an underneath surface of an arcuate foil through which hair to be cut can pass. A plurality of protruding cutting edges can be formed along the two opposite sides of the arch-shaped cutting strips and spaced apart from each other. Each protruding cutting edge can be defined by an extension of the top surface of the cutting strip and a bottom surface inclined at a first acute angle with respect to the extension of the top surface. A plurality of recessed cutting edges can be defined by the plurality of protruding cutting edges. Each recessed cutting edge can be defined by the top surface of the cutting strip and the side of the cutting strip inclined at a second acute angle with respect to the top surface. The protruding cutting edges of one cutting strip may be facing the recessed cutting edges of an adjacent cutting strip, thereby generating continuous hair-lifting and hair-cutting actions as the open cutter is driven in oscillating directions by a motor.

In one embodiment, the first acute angle is about 45°, and the second acute angle is greater than 75°. The plurality of arch-shaped cutting strips may be disposed at an oblique angle with respect to the oscillating directions. The oblique angle may be between 5° and 15°. The plurality of arch-shaped cutting strips may also be disposed perpendicular to the oscillating directions. The thickness of the metal plate may be less than 1 mm and the metal plate may be made of stainless steel.

According to another aspect, there is provided a method for fabricating an open cutter for a foil type shaver including the steps of (i) stamping a metal plate to form thereon alternating parallel slots and cutting strips, each cutting strip having two opposite sides and a top surface; (ii) shearing the stamped metal plate to form a plurality of protruding cutting edges along the two opposite sides of the cutting strips and spaced apart from each other, each protruding cutting edge being defined by an extension of the top surface of the cutting strip and a bottom surface inclined at a first acute angle with respect to the extension of the top surface; and a plurality of recessed cutting edges defined by the plurality of protruding cutting edges, each recessed cutting edge being defined by the top surface of the cutting strip and the side of the cutting strip inclined at a second acute angle with respect to the top surface; and (iii) forming the cutter having a plurality of arch-shaped cutting strips by bending the stamped and sheared metal plate into an arch shape.

The method may further include the step of profile grinding the formed cutter. The first acute angle formed at the protruding cutting edges may be about 45°, and the second acute angle formed at the recessed cutting edges may be greater than 75°. The metal plate may be made of stainless steel.

According to yet another aspect, there is provided a foil type shaver including an arcuate foil and an open cutter slidably coupled underneath the arcuate foil. The open cutter may include a plurality of arch-shaped cutting strips formed by bending a metal plate formed with alternating parallel slots and cutting strips. Each arch-shaped cutting strip may have two opposite sides and a top surface in sliding contact with an underneath surface of the arcuate foil through which hair to be cut can pass. A plurality of protruding cutting edges may be formed along the two opposite sides of the arch-shaped cutting strips and spaced apart from each other. Each protruding cutting edge being can be defined by an extension of the top surface of the cutting strip and a bottom surface inclined at a first acute angle with respect to the extension of the top surface. A plurality of recessed cutting edges can be defined by the plurality of protruding cutting edges. Each recessed cutting edge can be defined by the top surface of the cutting strip and the side of the cutting strip inclined at a second acute angle with respect to the top surface. The protruding cutting edges of one cutting strip may be facing the recessed cutting edges of an adjacent cutting strip, thereby generating continuous hair-lifting and hair-cutting actions as the open cutter is driven in oscillating directions by a motor.

In one embodiment, the first acute angle may be about 45°, and the second acute angle may be greater than 75°. The plurality of arch-shaped cutting strips may be disposed at an oblique angle with respect to the oscillating directions. The oblique angle may be between 5° and 15°. The thickness of the metal plate may be less than 1 mm, and the metal plate may be made of stainless steel.

Although the open cutter for a foil type shaver disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the open cutter for a foil type shaver disclosed in the present application will now be described by way of example with reference to the accompanying drawings wherein.

DETAILED DESCRIPTION

Figure 1:
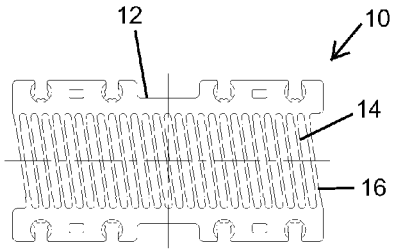
FIG. 1 is a top view of a stamped metal plate for forming into an open cutter according to an embodiment of the present application.

Reference will now be made in detail to a preferred embodiment of the open cutter for a foil type shaver disclosed in the present application, examples of which are also provided in the following description. Exemplary embodiments of the open cutter for a foil type shaver disclosed in the present application are described in detail, although it will be apparent to those skilled in the relevant art that some features that are not particularly important to an understanding of the open cutter for a foil type shaver may not be shown for the sake of clarity.

In addition, improvements and modifications which may become apparent to persons of ordinary skill in the art after reading this disclosure, the drawings, and the appended claims are deemed within the spirit and scope of the appended claims.

Certain terminology is used in the following description for convenience only and is not limiting. The words "upper", "lower", "top", and "bottom" designate directions in the drawings to which reference is made. The terminology includes the words noted above as well as derivatives thereof and words of similar import.

FIG. 1 shows a metal plate 12 for forming into an open cutter 10 for a foil type shaver according to an embodiment of the present application. The metal plate 12 may be formed with alternating parallel slots 14 and cutting strips 16 by stamping. The thickness of the metal plate 12 may be less than 1 mm. The metal plate 12 may be made of stainless steel or any other suitable material.

Figure 2:
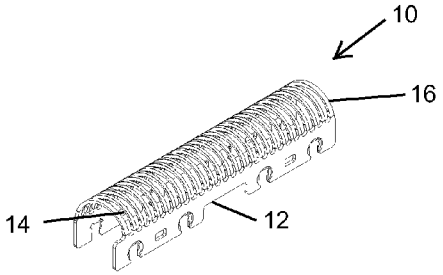
FIG. 2 is a perspective of the open cutter formed from the stamped metal plate of FIG. 1 into an arcuate configuration according to an embodiment of the present application.

FIG. 2 depicts the open cutter 10 having a plurality of arch-shaped cutting strips 16 formed by bending the metal plate 12 along its longitudinal axis. The plurality of arch-shaped cutting strips 16 may be parallel to each other and spaced along the oscillating directions of the open cutter 10, as shown by the arrows in FIG. 3. Each arch-shaped cutting strip 16 may have two opposite sides 20, 22 and a top surface 30.

One of the two opposite sides 20 may be generally facing one of the oscillating directions; whereas the other one of the two opposite sides 22 may be generally facing the other oscillating direction. The top surfaces 30 are arcuate in shape and are in sliding contact with an underneath surface of an arcuate foil (not shown) through which hair to be cut can pass.

Figure 3:
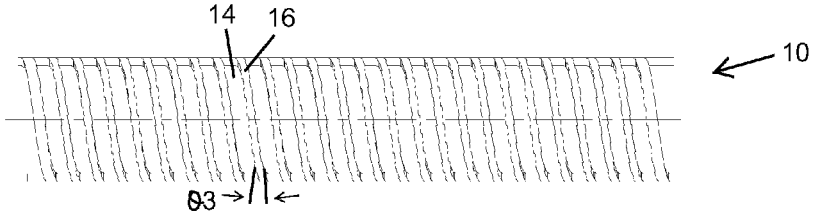
FIG. 3 is a top view of the open cutter in FIG. 2.
Figure 4:
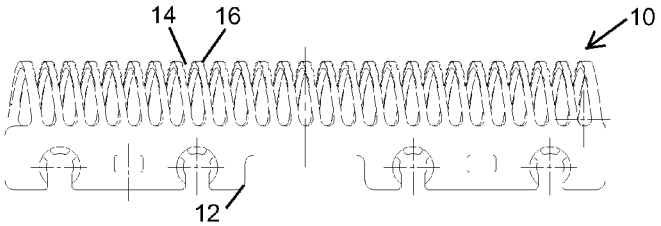
FIG. 4 is a side view of the open cutter in FIG. 2.
Figure 5:
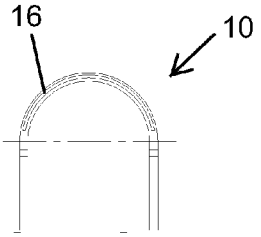
FIG. 5 is an end view of the open cutter in FIG. 2.
Figure 6:
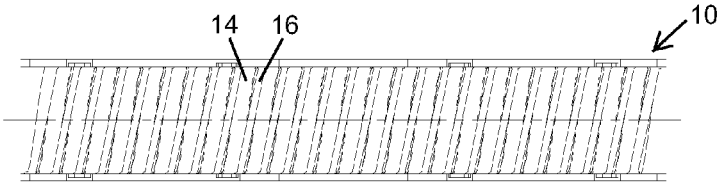
FIG. 6 is a bottom view of the open cutter in FIG. 2.

FIGS. 3 to 6 are different views of the open cutter 10 of FIG. 2. The plurality of arch-shaped cutting strips 16 may be disposed at an oblique angle θ3 with respect to the oscillating directions, as illustrated in FIG. 3. It is appreciated by one skilled in the art that the plurality of arch-shaped cutting strips 16 at an oblique angle can provide a better catch and shearing force for the hair. The oblique angle θ3 may be between 5° and 15°. According to the illustrated embodiment, the plurality of arch-shaped cutting strips 16 may be oriented at 8° with respect to the oscillating directions.

Although it has been shown and described that the plurality of arch-shaped cutting strips 16 is disposed at an oblique angle with respect to the oscillating directions, it is understood that the plurality of arch-shaped cutting strips 16 can also be disposed perpendicular to the oscillating directions.

Figure 7:
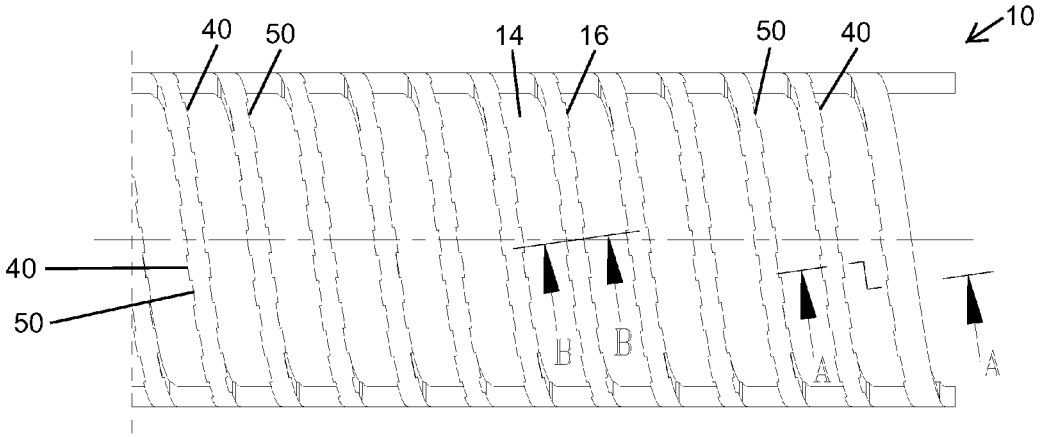
FIG. 7 is an enlarged cut-away top view of the open cutter in FIG. 2.
Figure 8:
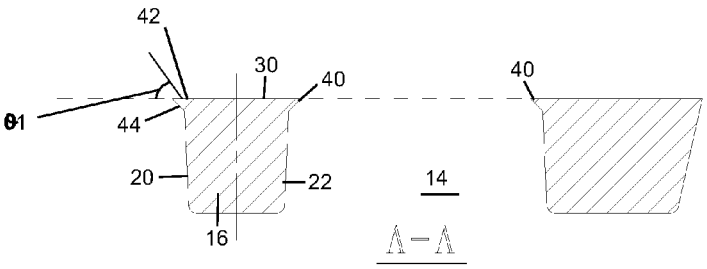
FIG. 8 is a cross sectional view of two cutting strips taken along line A-A in FIG. 7.
Figure 10:
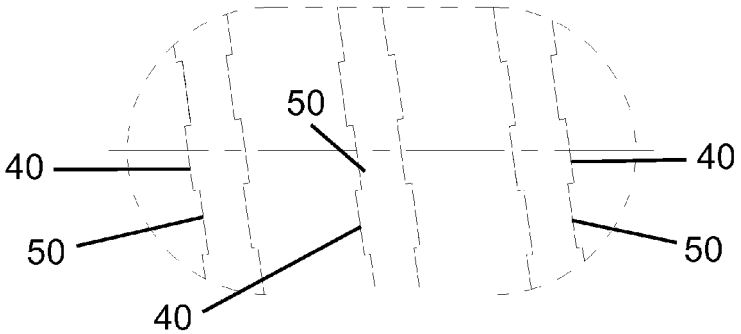
FIG. 10 is an enlarged fragmentary view of three cutting strips of the open cutter.

As depicted in FIGS. 7 and 10, a plurality of protruding cutting edges 40 may be formed along the two opposite sides 20, 22 of the cutting strips 16 and spaced apart from each other. The plurality of protruding cutting edges 40 is generally teeth-shaped. Each protruding cutting edge 40 can be defined by an extension 42 of the top surface 30 of the cutting strip 16 and a bottom surface 44 inclined at a first acute angle θ1 with respect to the extension 42 of the top surface 30 of the cutting strip 16, as shown in FIG. 8. According to the illustrated embodiment in FIG. 8, the first acute angle θ1 or cutting angle is about 45°.

Figure 9:
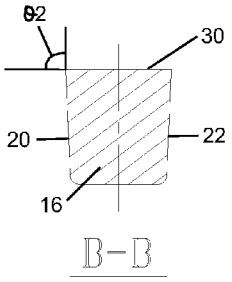
FIG. 9 is a cross sectional view of one cutting strip taken along line B-B in FIG. 7.

A plurality of recessed cutting edges 50 can be formed between and defined by the plurality of protruding cutting edges 40. Each recessed cutting edge 50 can be defined by the top surface 30 of the cutting strip 16 and the side 20, 22 of the cutting strip 16 inclined at a second acute angle θ2 with respect to the top surface 30 of the cutting strip 16, as shown in FIG. 9. The second acute angle θ2 or cutting angle may be greater than 75°.

According to the illustrated embodiment, there are 6-7 protruding cutting edges 40 and 6-7 recessed cutting edges 50 formed on each side of the cutting strips 16, although the number may vary. The protruding cutting edges 40 and the recessed cutting edges 50 may have the same length. According to one embodiment, the length of the protruding cutting edges 40 and the recessed cutting edges 50 is about 0.5 mm.

According to the illustrated embodiment, the open cutter 10 has 27 arch-shaped cutting strips 16 although the number may vary depending on the size of the shaver. The distance between two protruding cutting edges 40 of two adjacent cutting strips 16 may be about 0.8 mm.

The protruding cutting edges 40 of one cutting strip 16 may be facing the recessed cutting edges 50 of an adjacent cutting strip 16, thereby generating continuous hair-lifting and hair-cutting actions as the open cutter 10 is driven in the oscillating directions by a motor.

The open cutter 10 can be fabricated by stamping, shearing and forming processes. The open cutter 10 may be fabricated by first stamping the metal plate 12 to form thereon the alternating parallel slots 14 and cutting strips 16 using a conventional metal stamping machine. Each cutting strip 16 would have two opposite sides 20, 22 and a top surface 30.

Thereafter, the stamped metal plate 12 may be sheared by suitable metal shearing tools to form a plurality of protruding cutting edges 40 along the two opposite sides 20, 22 of the cutting strips 16 and spaced apart from each other. Each protruding cutting edge 16 can be formed by an extension 42 of the top surface 30 of the cutting strip 16 and a bottom surface 44 inclined at a first acute angle θ1 with respect to the extension 42 of the top surface 30. A plurality of recessed cutting edges 50 can be formed and defined by the plurality of protruding cutting edges 40. Each recessed cutting edge 50 can be formed by the top surface 30 of the cutting strip 16 and the side 20, 22 of the cutting strip 16 inclined at a second acute angle θ2 with respect to the top surface 30 of the cutting strip 16.

According to the illustrated embodiment, the first acute angle θ1 formed at the protruding cutting edges 40 may be about 45° and the second acute angle θ2 formed at the recessed cutting edges 50 can be greater than 75°.

The plurality of arch-shaped cutting strips 16 can then be formed by bending the stamped and sheared metal plate 12 into an arch shape. Finally, profile grinding may be performed on the formed open cutter 10.

While the open cutter for a foil type shaver disclosed in the present application has been shown and described with particular references to a number of preferred embodiments thereof, it should be noted that various other changes or modifications may be made without departing from the scope of the appending claims.

What is claimed is:

1. A method for fabricating an open cutter for a foil type shaver comprising the steps of:

(a) stamping a metal plate to form thereon alternating parallel slots and cutting strips, each cutting strip having two opposite sides and a top surface;

(b) shearing the stamped metal plate to form a plurality of protruding cutting edges along the two opposite sides of the cutting strips and spaced apart from each other, each protruding cutting edge being defined by an extension of the top surface of the cutting strip and a bottom surface inclined at a first acute angle with respect to the extension of the top surface; and a plurality of recessed cutting edges defined by the plurality of protruding cutting edges, each recessed cutting edge being defined by the top surface of the cutting strip and the side of the cutting strip inclined at a second acute angle with respect to the top surface; and (c) forming the cutter having a plurality of arch-shaped cutting strips by bending the stamped and sheared metal plate into an arch shape.

2. The method as claimed in claim 1, further comprising the step of profile grinding the formed cutter.

3. The method as claimed in claim 1, wherein the first acute angle formed at the protruding cutting edges is about 45°.

4. The method as claimed in claim 1, wherein the second acute angle formed at the recessed cutting edges is greater than 75°.

5. The method as claimed in claim 1, wherein the metal plate is made of stainless steel.

* * * * *